US009263010B2

(12) United States Patent
Trask

(10) Patent No.: US 9,263,010 B2
(45) Date of Patent: Feb. 16, 2016

(54) MULTI-TONAL BOX DRUM KIT

(71) Applicant: Joshua Trask, Moravian Falls, NC (US)

(72) Inventor: Joshua Trask, Moravian Falls, NC (US)

( * ) Notice: Subject to any disclaimer, the term of this patent is extended or adjusted under 35 U.S.C. 154(b) by 157 days.

(21) Appl. No.: 13/965,704

(22) Filed: Aug. 13, 2013

(65) Prior Publication Data

US 2014/0041508 A1 Feb. 13, 2014

Related U.S. Application Data

(60) Provisional application No. 61/682,483, filed on Aug. 13, 2012.

(51) Int. Cl.
*G10D 13/02* (2006.01)
*G10D 13/08* (2006.01)

(52) U.S. Cl.
CPC ..... *G10D 13/025* (2013.01); *G10D 13/02* (2013.01); *G10D 13/08* (2013.01)

(58) Field of Classification Search
CPC ..... G10D 13/025
USPC ..... 84/415
See application file for complete search history.

(56) References Cited

U.S. PATENT DOCUMENTS

| | | | | |
|---|---|---|---|---|
| 5,385,075 | A * | 1/1995 | Carnes et al. | 84/411 R |
| 7,482,522 | B2 * | 1/2009 | Wening | 84/415 |
| 7,534,948 | B2 * | 5/2009 | Rice | 84/404 |
| 8,263,848 | B2 * | 9/2012 | Aspland | 84/415 |
| 8,350,138 | B2 * | 1/2013 | Schmader | 84/411 R |
| 8,829,321 | B2 * | 9/2014 | Klein | 84/411 R |
| 2012/0132058 | A1 * | 5/2012 | Dublin | 84/723 |

* cited by examiner

*Primary Examiner* — Jianchun Qin
(74) *Attorney, Agent, or Firm* — James M Smedley LLC

(57) ABSTRACT

The present invention generally relates to cajón drums. Specifically, this invention relates to a multi-tonal box drum kit that provides a form factor that is easy and convenient to use while producing the tones and sounds of a full drum kit or some subset thereof.

18 Claims, 7 Drawing Sheets

MULTI-TONAL BOX DRUM KIT

CROSS-REFERENCE TO RELATED APPLICATIONS

This application claims the benefit of the following provisional application, each of which is hereby incorporated by reference in its entirety: U.S. Pat. App. No. 61/682,483 filed on Aug. 13, 2012 and entitled "Multi-Tonal Box Drum Kit".

FIELD OF THE INVENTION

The present invention generally relates to cajón drums. Specifically, this invention relates to a multi-tonal box drum kit that provides a form factor that is easy and convenient to use while producing the tones and sounds of a full drum kit or some subset thereof.

BACKGROUND

Musical instruments come in a variety of types and forms. In particular, percussion instruments are perhaps some of the most diverse with it comes to the various forms, shapes, and sizes that percussion instruments exist in. The variety of the percussion instruments, however, are important for the types of sound those instruments produce and this fact is especially evident with drums. The size and construction of a drum are the primary factors that determine what tones and sounds the drum will ultimately be capable of producing. As a result, a musician or group of musicians often have multiple types of drums to adequately produce a variety of sounds and tones. This, however, can be very inconvenient as drums tend to be bulky and more difficult to transport when compared to other types of instruments, therefore putting a musician in a less than ideal situation where the musician may not have the resources to efficiently transport all the drums the musician needs.

Therefore, there is a need in the art for an apparatus that provides a compact and convenient multi-tonal drum box that is capable of producing the sounds of a variety of drums within the form factor of single drum body. These and other features and advantages of the present invention will be explained and will become obvious to one skilled in the art through the summary of the invention that follows.

SUMMARY OF THE INVENTION

Accordingly, it is an aspect of the present invention to provide a multi-tonal drum box that allows a musician to create the sounds of multiple types of drums from a single drum body. Furthermore, the multi-tonal drum box offers the musician a convenient and easy to transport drum that only requires the musician to transport one drum where many drums were previously required.

According to an embodiment of the present invention, a multi-tonal box drum includes: a drum body portion, comprising a plurality of exterior walls, wherein each exterior wall of said plurality of exterior walls comprises one or more tone zones, wherein each of said one or more tone zones corresponds to a drum sound selected from a group of drum sounds comprising snare drum sounds, bass drum sounds, and tom-tom drum sounds; an internal tonal structure, comprising one or more support arms, and one or more tone generating arms, wherein said one or more support arms are configured to define said one or more tone zones and provide support to said drum body portion, wherein said one or more tone generating arms are configured to shape said one or more tone zones; and an adjustable snare component, wherein said adjustable snare component is configured to produce said snare drum sounds, wherein said adjustable snare component can be regulated by a snare adjustment component to alter said snare drum sounds.

According to an embodiment of the present invention, the multi-tonal drum kit is substantially rectangular in shape.

According to an embodiment of the present invention, the multi-tonal drum kit further includes a shaker component.

According to an embodiment of the present invention, the shaker apparatus reversibly engages with said drum body portion.

According to an embodiment of the present invention, the multi-tonal drum kit further includes a kick pedal attachment.

According to an embodiment of the present invention, the kick pedal apparatus is comprised of a kick drum pedal.

According to an embodiment of the present invention, the kick pedal apparatus is comprised of a beater component.

According to an embodiment of the present invention, the beater component is comprised of an attachment rod, an interior dowel rod, a middle cushion component, and an exterior tapping component.

According to an embodiment of the present invention, the drum body portion is further comprised of one or more feet.

According to an embodiment of the present invention, the one or more exterior walls may be further comprised of one or more bass reflex ports.

According to an embodiment of the present invention, a multi-tonal box drum includes: a plurality of exterior walls connected in such a manner as to form an interior cavity, wherein a portion of one of more exterior walls of said plurality of exterior walls comprises one or more tone zones, wherein each of said one or more tone zones corresponds to a drum sound selected from a group of drum sounds comprising snare drum sounds, bass drum sounds, and tom-tom drum sounds; an internal tonal structure situated inside said interior cavity, comprising one or arms, each of said one or more arms comprising one or more of more a support arm and a tone generating arm, wherein each of said support arms is configured to provide support to one or more exterior walls of said plurality of exterior walls, wherein said one or more tone generating arms are configured to shape one or more tones generated by one or more tone zones of said one or more tone zones.

According to an embodiment of the present invention, the multi-tonal box drum further includes an adjustable snare component, wherein said adjustable snare component is configured to produce snare drum sounds.

According to an embodiment of the present invention, adjustable snare component can be regulated by a snare adjustment component to alter said snare drum sounds.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

FIGS. 11*a*-11*e* shows a perspective view of a component of a box drum kit, in accordance with an embodiment of the present invention.

DETAILED SPECIFICATION

Figure 1:
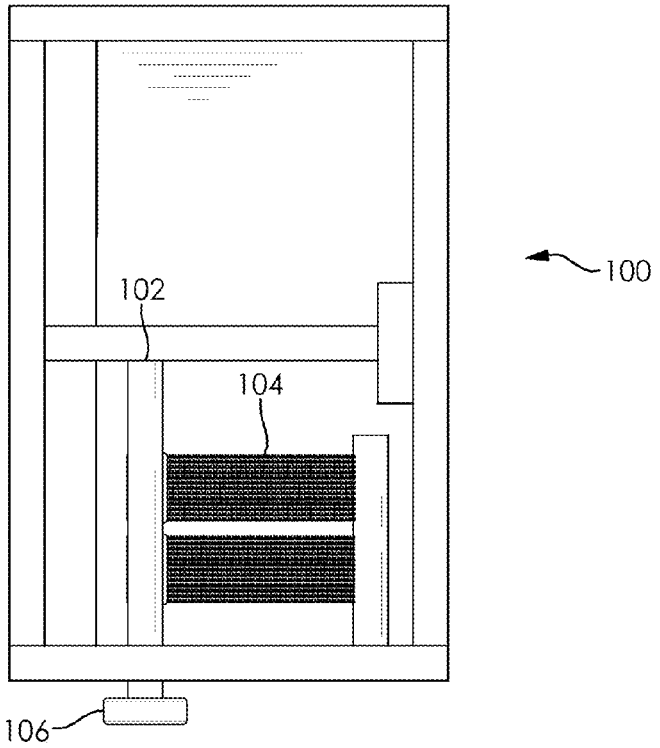
FIG. 1 shows a perspective view of a multi-tonal box drum kit, in accordance with an embodiment of the present invention.

The present invention generally relates to cajón drums. Specifically, this invention relates to a multi-tonal box drum kit that provides a form factor that is easy and convenient to use while producing the tones and sounds of a full drum kit or some subset thereof. Embodiments of the present invention are generally comprised of a boxed shaped drum body portion and an internal tonal structure.

According to an embodiment of the present invention, a multi-tonal box drum kit is comprised of a box shaped drum body portion. The drum body portion, in preferred embodiments, is comprised of a substantially rectangular shape that is solid on all six exterior walls except for one or more bass reflex ports. Alternative embodiments of the present invention may be comprised of a drum body portion of various shapes, including, but not limited to, squares, polygons and cylinders. One of ordinary skill in the art would appreciate that there are numerous shapes that could be used for the drum body portion of embodiments of the present invention, and embodiments of the present invention are contemplated for use with drum body portion of any shape. Further, in certain embodiments, the drum body portion may be devoid of bass reflex ports.

According to an embodiment of the present invention, the internal tonal structure is configured to provide shape and structure to the multi-tonal box drum kit such that the exterior walls of the drum body portion can attach to the internal tonal structure in a manner that allows for the generation of numerous drum sounds, percussion sounds or drum-like sounds. In a preferred embodiment of the present invention, the internal tonal structure is configured to provide seven unique tone zones. Each tone zone represents a zone whereby when that zone is played, a drum sound is generated. Drum sounds include, but are not limited to, bass drum sounds, snare drum sounds, tom-tom drum sounds, or any combination thereof. The tone of a tone zone may be directed by one or more of the size and shape of the tone zone, as directed by the internal tonal structure(s) and external surfaces of the multi-tonal box drum kit, the materials used for each tone zone, and the thickness of the materials used for the internal tonal structure (s) and external surfaces, or any combination thereof. For instance, the bass tone may be affected by the cubic inches of void space inside the multi-tonal box drum kit. In this manner, manipulation of the features of a tone zone may provide melodic capability to the instrument in such a way that the tones of the multi-tonal box drum kit may extend beyond drum tones and other percussion tones. One of ordinary skill in the art would appreciate that there are numerous drum sounds that could be produced by a tone zone, and embodiments of the present invention are contemplated for use with any drum sound.

According to an embodiment of the present invention, the multi-tonal box drum kit may be further comprised of one or more feet, configured to elevate the multi-tonal box drum kit off of the surface it rests upon. By elevating the multi-tonal drum kit, the one or more feet provide the ability for the multi-tonal drum kit to resonate as much as possible, creating deeper and richer tones and sounds. In a preferred embodiment, the multi-tonal box drum kit may utilize four large rubber feet. In alternate embodiments, any number of feet may be utilized.

According to an embodiment of the present invention, In usage, the multi-tonal box drum kit is played by a user sitting next to, behind, on or to a side of the multi-tonal box drum kit. This differs from other cajón drums, where the user sits on the drum while playing the instrument. Advantageously, by not sitting on the multi-tonal box drum kit, improved resonation and tones are achieved. Further, by not sitting on the multi-tonal box drum kit, the user is provided greater access to multiple exterior walls of the multi-tonal box drum kit, which are designed with a variety of unique tones and sounds much like that found in a full drum kit (i.e., the numerous tone zones). This allows the user to quickly switch from tone zone to tone zone, producing an entire array of drum sounds.

According to an embodiment of the present invention, the multi-tonal box drum kit may be further comprised of an adjustable snare component, which can produce everything from no snare to an extremely aggressive snare buzz, and everything in between. The adjustable snare component is attached to or integrally constructed with the internal tonal structure of the multi-tonal box drum kit. In certain embodiments, a snare adjustment component may extend through an exterior wall of the drum body portion and provide the user the ability to adjust the snare sound by adjusting the snare adjustment component. The snare sound may be adjusted from completely muted (i.e., off) to high rattle, or anywhere in between. In a preferred embodiment, the snare adjustment component is comprised of a knob that can be rotated to adjust the snare sound. In addition to adjusting the sound of the adjustable snare component, the adjustable snare component can also be adjusted to be used in various tone zones. For instance, the adjustable snare component can be adjusted to be used with the top tone zone on the top exterior wall of the multi-tonal box drum kit or adjusted to be used on one of the side tone zones on the side exterior walls of the multi-tonal box drum kit, allowing the player greater flexibility in the use of the drum.

According to an embodiment of the present invention, a bass tone zone and a snare tone zone of the multi-tonal box drum kit may be located on separate sides of the drum body portion of the multi-tonal box drum kit, allowing for superior definition between the bass and snare tones.

According to an embodiment of the present invention, the multi-tonal box drum kit can be played in multiple positions. In a preferred embodiment of the present invention, the multi-tonal box drum kit can be played on any one of the exterior walls of the multi-tonal box drum kit. Each exterior wall is configured to produce various drum sounds, depending on the arrangement of tone zones associated with the particular multi-tonal box drum kit.

Figure 2:
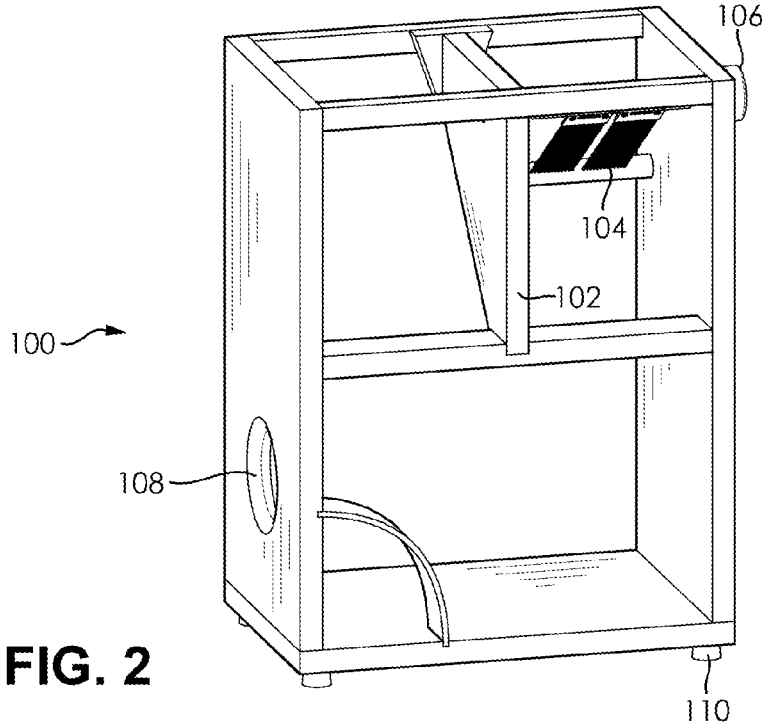
FIG. 2 shows a side view of a multi-tonal box drum kit, in accordance with an embodiment of the present invention.

Turning now to FIGS. 1-2, views of an exemplary embodiment of the multi-tonal box drum kit 100 are shown. In these views, the internal tonal structure 102 of the multi-tonal box drum kit 100 are shown. Various support arms are shown as well as tone generating arms. Support arms provide the dual purpose of shaping the tone zones of the multi-tonal box drum kit as well as providing support for the overall structure. Tone generating arms are configured to shape tone zones for the multi-tonal box drum kit without providing significant structural support. Also shown in these views are the adjustable snare component 104 and the snare adjustment component 106. The snare adjustment component 106 regulates the adjustable snare component 104 to product varying snare drum sounds. Finally, FIG. 2 shows a bass reflex port 108 and feet 110.

Figure 3A:
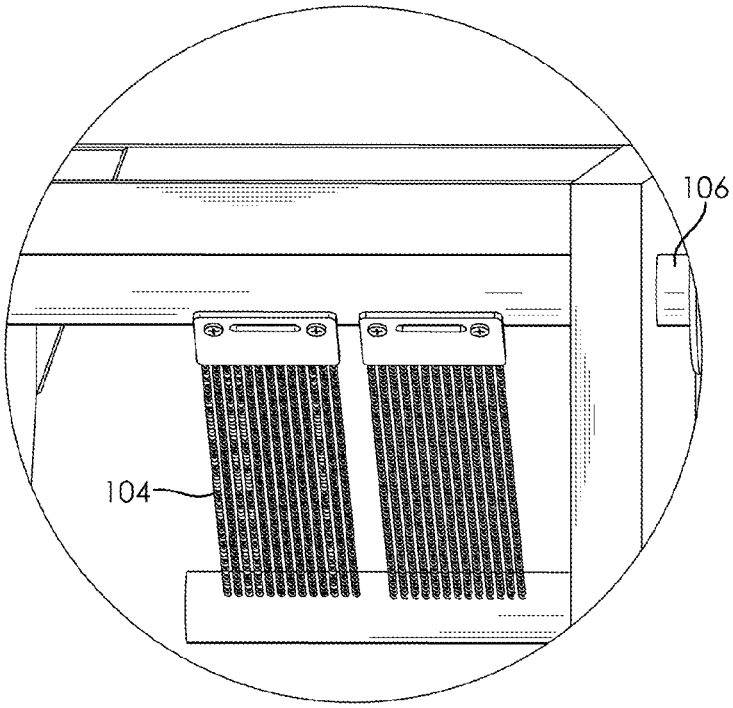
FIG. 3A shows a detailed view of a snare drum component of a multi-tonal box drum kit, in accordance with an embodiment of the present invention.
Figure 3B:
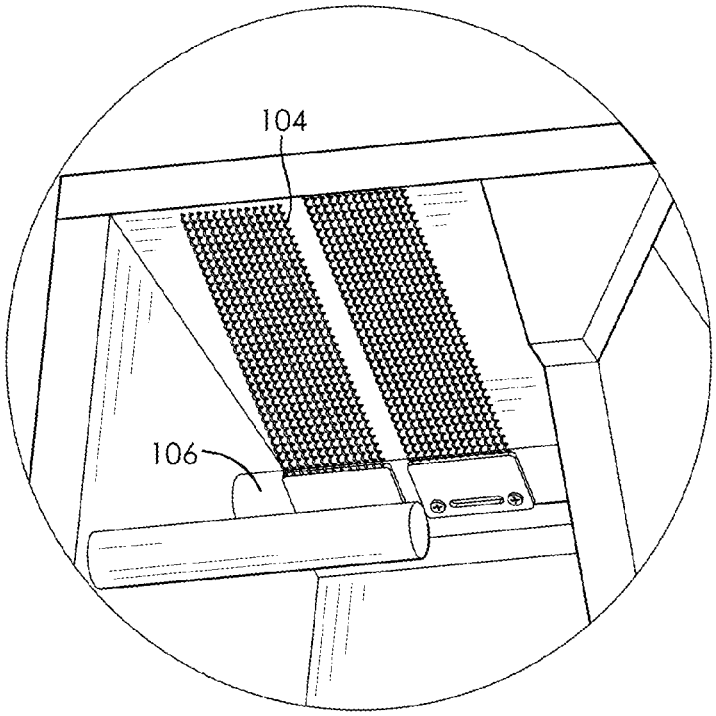
FIG. 3B shows a detailed view of an adjustable snare component attached to a snare adjustment component which has been adjusted so that the snare component contacts the top wall of the drum, in accordance with an embodiment of the present invention.
Figure 3C:
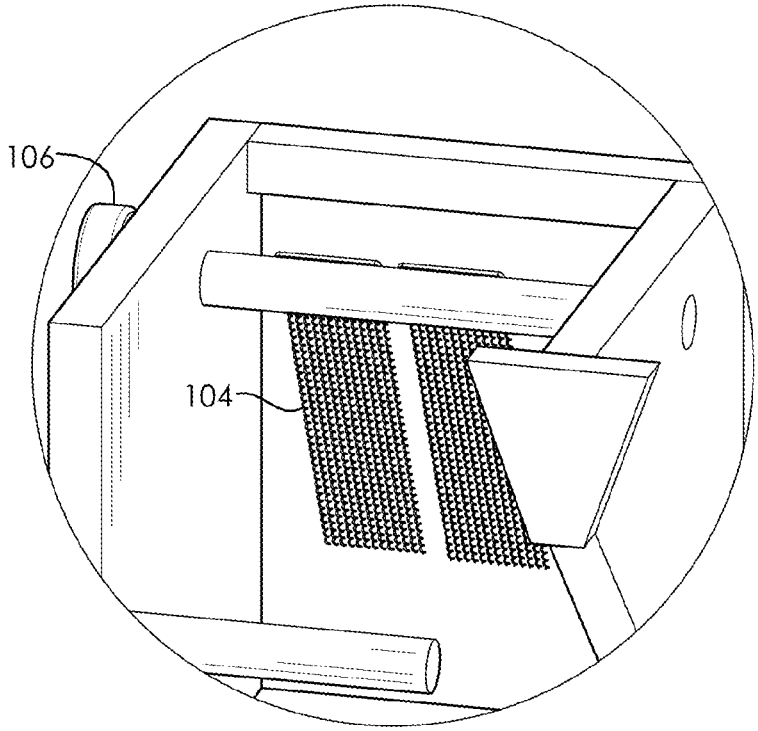
FIG. 3C shows a detailed view of an adjustable snare component attached to a snare adjustment component which has been adjusted so that the snare component contacts a side wall of the drum, in accordance with an embodiment of the present invention.
Figure 4:
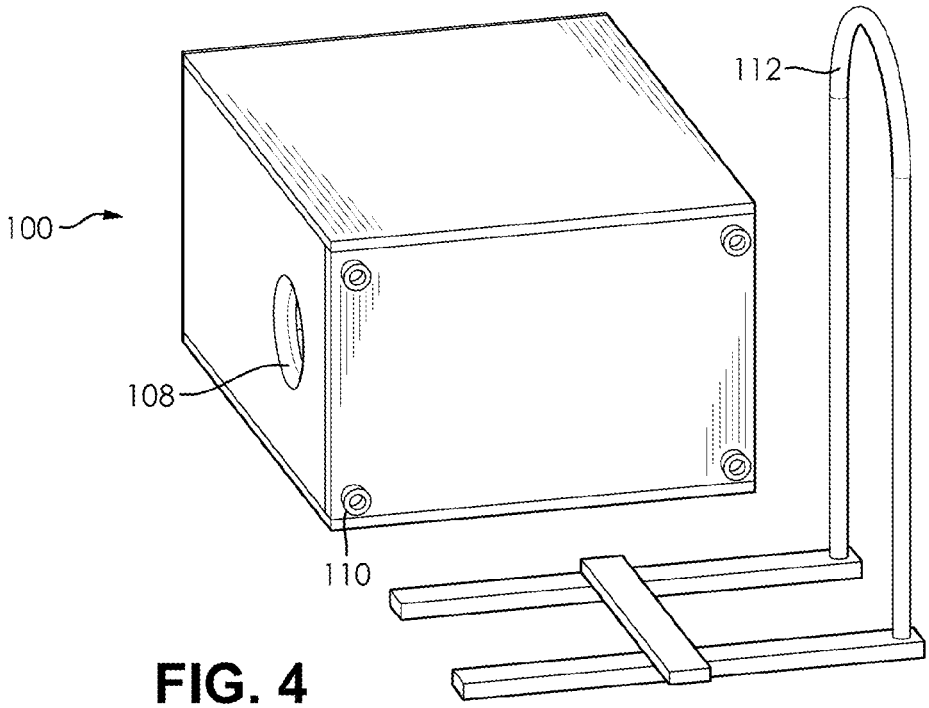
FIG. 4 shows a bottom view of a multi-tonal box drum kit, in accordance with an embodiment of the present invention.
Figure 5:
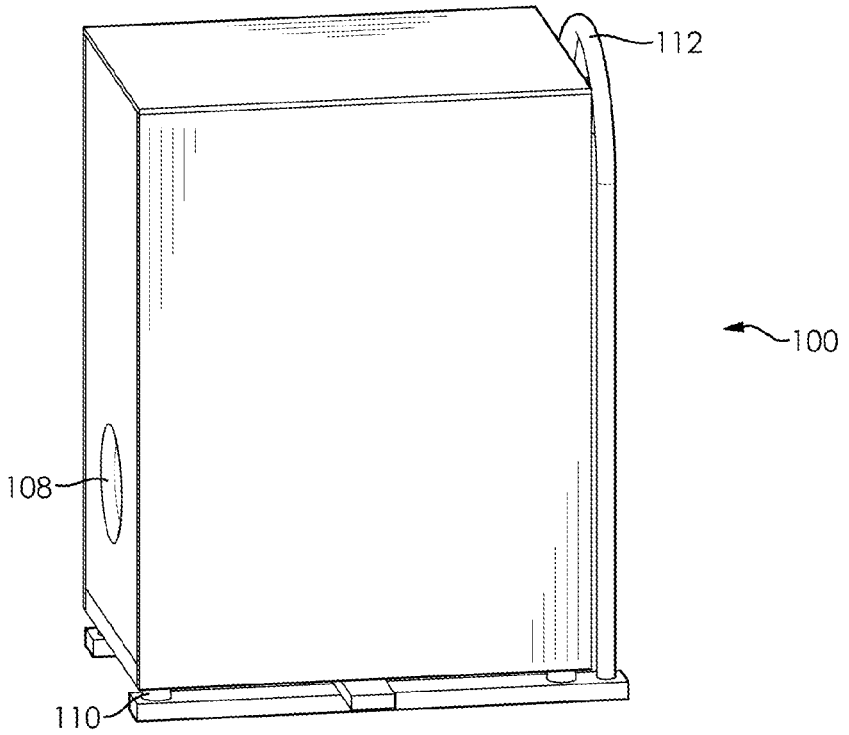
FIG. 5 shows a side view of a multi-tonal box drum kit, in accordance with an embodiment of the present invention.
Figure 6:
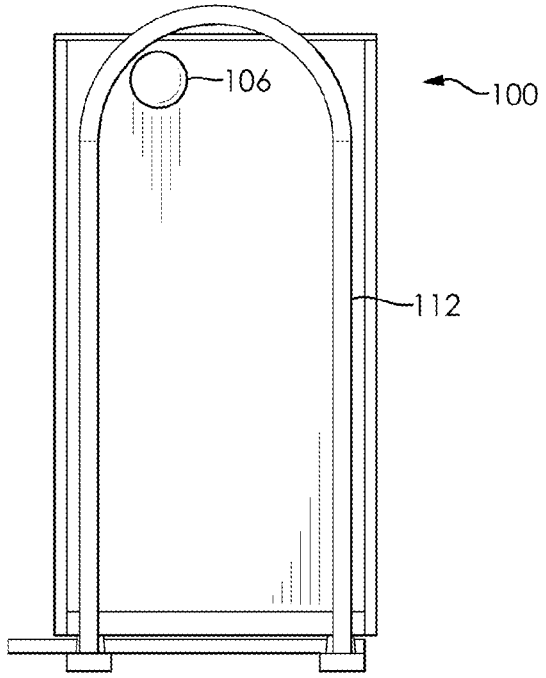
FIG. 6 shows a rear view of a multi-tonal box drum kit, in accordance with an embodiment of the present invention.
Figure 7:
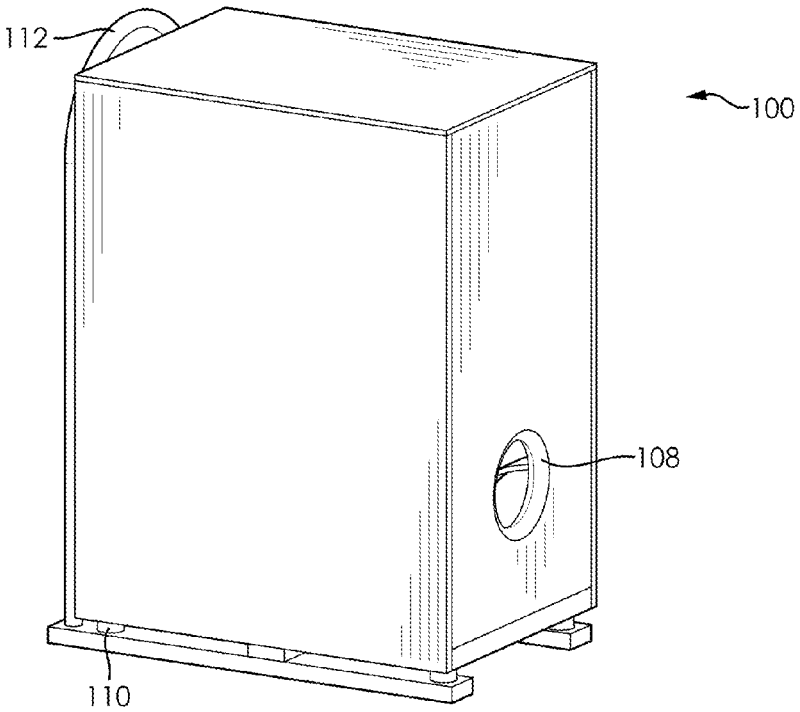
FIG. 7 shows a perspective view of a multi-tonal box drum kit, in accordance with an embodiment of the present invention.
Figure 8:
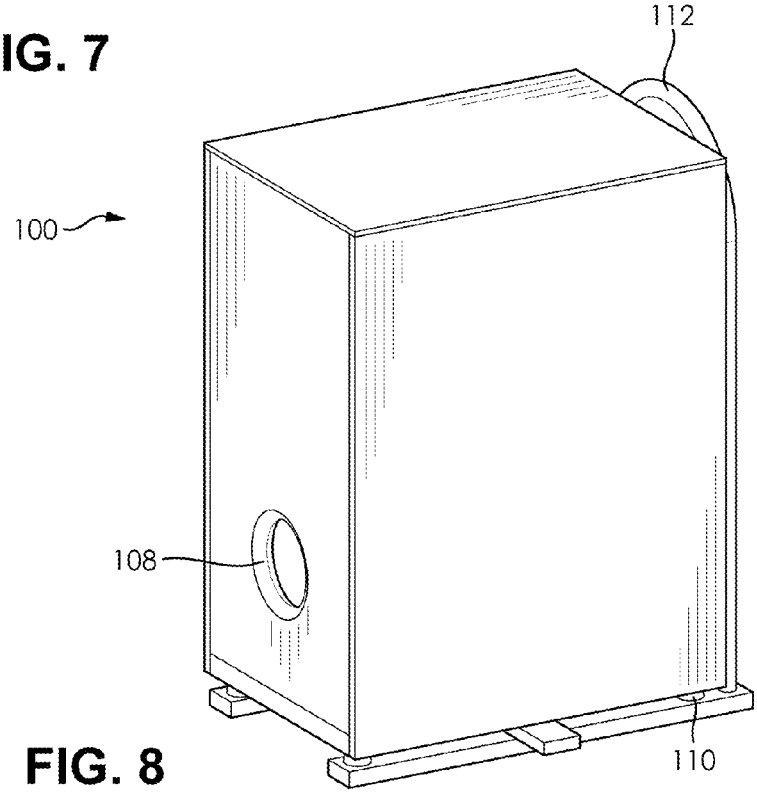
FIG. 8 shows a perspective view of a multi-tonal box drum kit, in accordance with an embodiment of the present invention.

Turning now to FIG. 3A, a zoomed-in view of an adjustable snare component 104 is shown. In this exemplary embodiment, the adjustable snare component 104 is comprised of an adjustable rotating arm attached to a snare component and a second stationary arm. The adjustable rotating arm extends through the exterior wall of the box shaped drum body portion (generally on the rear exterior wall of the multi-tonal box drum kit) and attaches to a snare adjustment component 106, such as a knob, that allows the user to adjust the adjustable snare component conveniently from a playable position. Furthermore, according to an exemplary embodiment, the adjustable snare component can be rotated until the snare component contacts the top tone zone on the top exterior wall of the multi-tonal box drum kit (as shown in FIG. 3B) or adjusted so that the snare component contacts one of the side tone zones on a side exterior wall of the multi-tonal box drum kit (as shown in FIG. 30).

Turning now to FIGS. 4-9, views of an embodiment of a multi-tonal box drum kit 100 are shown. In these views, various angles are shown of a multi-tonal box drum kit 100, including an optional shaker component 112 and a kick pedal attachment 114, which includes a kick drum pedal 116 and a beater component 118. These views, also include other components of the multi-tonal drum box kit 100, including a snare adjustment component 106, a bass reflex port 108, and feet 110.

Figure 9:
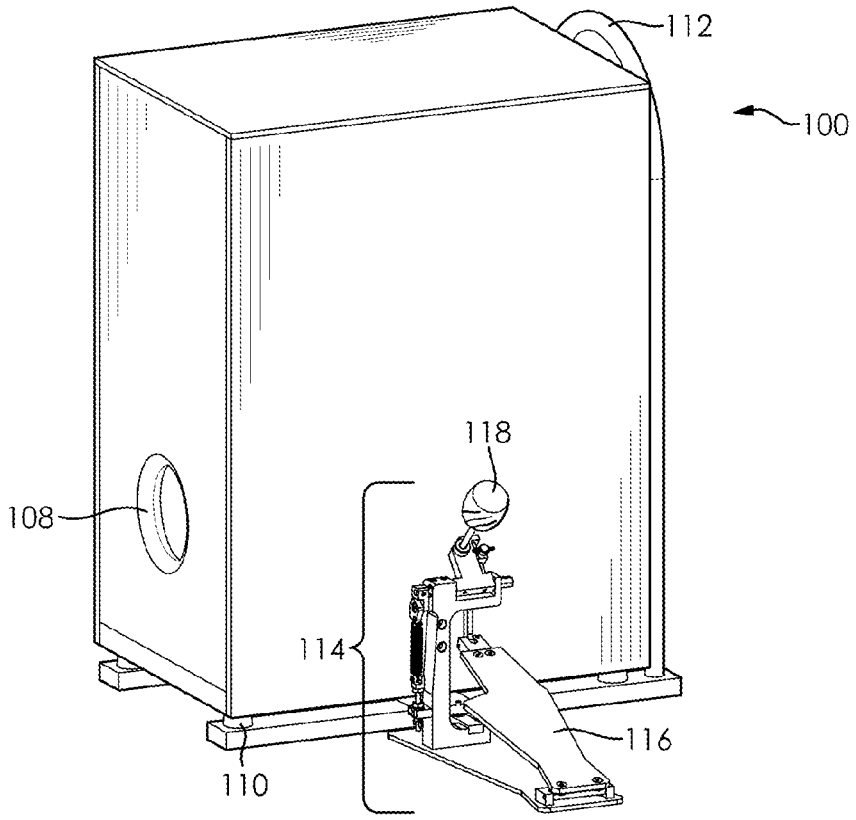
FIG. 9 shows a perspective view of a multi-tonal box drum kit, in accordance with an embodiment of the present invention.
Figure 10:
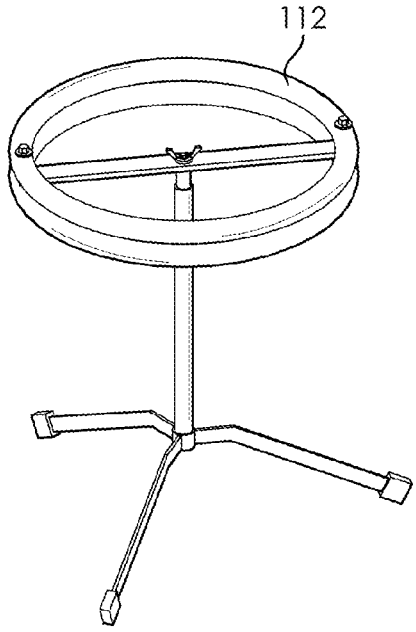
FIG. 10 shows a view of a component of a multi-tonal box drum kit, in accordance with an embodiment of the present invention.

According to an embodiment of the present invention, the shaker component 112 may be its own instrument (as shown in FIG. 10), or a component of the multi-tonal box drum kit 100 (as shown in FIGS. 4-9). In certain embodiments, the shaker component 112 is comprised of a plurality of sealed chambers containing a rattle component (e.g., BBs, pellets, beads). The sealed chambers are configured in such a manner that a musician or other user of the shaker component can tap, hit, shake or otherwise manipulate the shaker component from any angle or direction and have a rattle or similar sound produced. As shown in FIGS. 4-10, the shaker component is configured in a horseshoe shape or otherwise rounded shape and comprised of a plurality of individual sealed chambers containing BBs. One of ordinary skill in the art would appreciate that the shaker component may be shaped in any number of shapes and may be comprised of any number of sealed chambers, and embodiments of the present invention are contemplated for use with any shape and number of sealed chambers for its shaker components.

According to an exemplary embodiment of the present invention, a kick pedal attachment 114 (as shown in FIG. 9) may be configured to allow for a musician or other user to create a kick drum tone from the multi-tonal box drum kit 100 without using his/her hands. In this manner, the user's foot or other limb may be utilized to generate the desired tones. In certain embodiments, the kick pedal attachment may be comprised of a kick drum pedal 116 and a beater component 118. One of ordinary skill in the art would appreciate that there are many suitable configurations for a kick pedal attachment, and embodiments of the present invention are contemplated for use with any such configuration of kick pedal attachment.

Figure 11C:
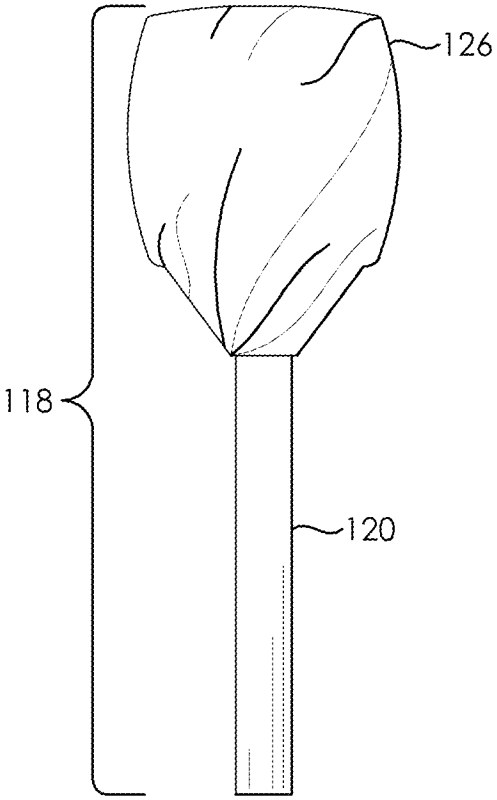
Figure 11B:
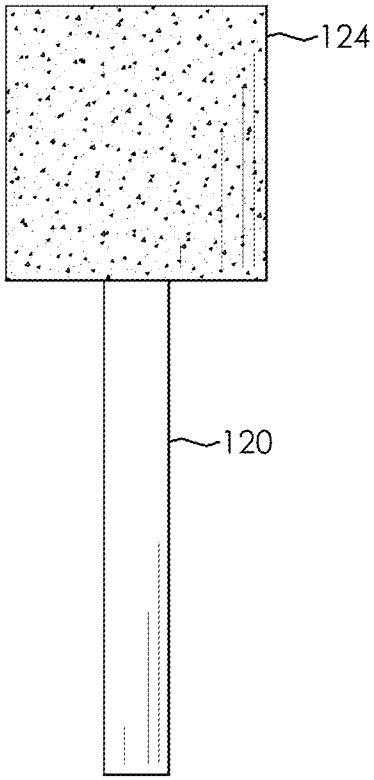
Figure 11A:
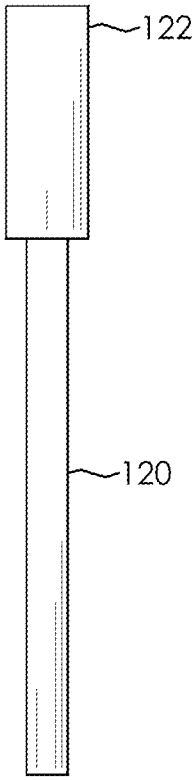

Turning now to FIGS. 11*a-c*, according to an exemplary embodiment of the present invention, a beater component 118 may be comprised of an attachment rod 120, an interior dowel rod 122, a middle cushion component 124, and an exterior tapping component 126. The attachment rod 120 is configured to secure the components of the beater component 118 to a kick drum pedal. The other components of the beater component (i.e., the interior dowel rod 122, the middle cushion component 124, and exterior tapping component 126) are configured to be used be used in conjunction with one another to hit an exterior wall of the drum body portion multi-tonal drum kit to generate a drum tone. Further, the combination of the interior dowel rod 122, middle cushion component 124, and exterior tapping component 126 are configured to provide tones that mimic those generated by a hand tapping on the multi-tonal drum kit. This occurs through the selection of materials for the interior dowel rod 122, the middle cushion component 124, and exterior tapping component 126 that approximate the characteristics of a human hand. The interior dowel rod 122 is designed to mimic bones in the human hand; the middle cushion component 124 designed to mimic the muscle and tissue of the human hand; and the exterior tapping component 124 designed to mimic the skin of the human hand. In combination, the tone produced when the beater component 118 strikes the multi-tonal drum kit is a close approximation of the sounds generated when a human hand hits the multi-tonal drum kit.

Turning now to FIG. 11*a*, according to an exemplary embodiment of the present invention, an interior dowel rod 122 may be comprised of, for instance, wooden materials or other materials approximating the density and/or other characteristics of bone, including animal bone. One of ordinary skill in the art would appreciate that there are numerous materials that could be utilized for the interior dowel rod, and embodiments of the present invention are contemplated for use with any material.

Turning now to FIG. 11*b*, according to an exemplary embodiment of the present invention, a middle cushion component 124 may be comprised of, for instance, Styrofoam or other materials approximating the density and/or other characteristics of human tissue. One of ordinary skill in the art would appreciate that there are numerous materials that could be utilized for the middle cushion component, and embodiments of the present invention are contemplated for use with any material.

Turning now to FIG. 11*c*, according to an exemplary embodiment of the present invention, an exterior tapping component 126 may be comprised of, for instance, animal skin, leather or other materials approximating the density and/or other characteristics of human skin. One of ordinary skill in the art would appreciate that there are numerous materials that could be utilized for the exterior tapping component, and embodiments of the present invention are contemplated for use with any material.

According to an embodiment of the present invention, the multi-tonal box drum kit may be constructed from various materials. The choice of materials assists in the generation of specific tones and sounds. In certain embodiments, various materials may be utilized in the construction of the various components of the multi-tonal box drum kit, including spruce, maple, redwood, African hardwoods, cherry, carbon fiber, fiberglass, Plexiglas, and oak. One of ordinary skill in the art would appreciate that there are numerous types of construction materials that could be utilized with embodiments of the present invention, and embodiments of the present invention are contemplated for use with any construction materials.

According to an embodiment of the present invention, the various exterior walls of the generally box-shaped drum body portion of the multi-tonal box drum kit may be connected via one or more attachment means. In preferred embodiments, the various exterior walls are connected via attachment means that create substantially air-tight seals allowing for greater resonance and tone. Exemplary attachment means include dove-tailed connections. One of ordinary skill in the art would appreciate that there are numerous types of attachment means that could be utilized with embodiments of the present invention, and embodiments of the present invention are contemplated for use with any type of attachment means.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. An multi-tonal box drum, said multi-tonal box drum comprising:

a drum body portion, comprising a plurality of exterior walls, wherein one or more exterior walls of said plurality of exterior walls comprises one or more tone zones, wherein each of said one or more tone zones corresponds to a drum sound selected from a group of drum sounds comprising snare drum sounds, bass drum sounds, and tom-tom drum sounds;

an internal tonal structure, comprising one or more support arms, and one or more tone generating arms, wherein said one or more support arms are configured to define said one or more tone zones and provide support to said drum body portion, wherein said one or more tone generating arms are configured to shape said one or more tone zones; and an adjustable snare component, wherein said adjustable snare component is configured to produce said snare drum sounds, wherein said adjustable snare component is capable of being regulated by a snare adjustment component that is adapted to move said adjustable snare component between at least a first tone zone and a second tone zone to alter said snare drum sounds.

2. The multi-tonal box drum of claim 1, wherein said multi-tonal box drum is substantially rectangular in shape.

3. The multi-tonal box drum of claim 1, wherein said multi-tonal box drum further includes a shaker component comprised of a plurality of shaker chambers configured to allow said shaker component to be struck from any direction.

4. The multi-tonal box drum of claim 3, wherein said shaker component reversibly engages with said drum body portion.

5. The multi-tonal box drum of claim 1, wherein said multi-tonal box drum further includes a kick pedal attachment.

6. The multi-tonal box drum of claim 5, wherein said kick pedal attachment is comprised of a kick drum pedal.

7. The multi-tonal box drum of claim 5, wherein said kick pedal attachment is comprised of a beater component.

8. The multi-tonal box drum of claim 7, wherein said beater component is comprised of an attachment rod, an interior dowel rod, a middle cushion component, and an exterior tapping component.

9. The multi-tonal box drum of claim 1, wherein said drum body portion is further comprised of one or more feet.

10. The multi-tonal box drum of claim 1, wherein said one or more exterior walls is further comprised of one or more bass reflex ports.

11. A multi-tonal box drum, said multi-tonal box drum comprising:

a plurality of exterior walls, each comprising an inner surface and an outer surface, wherein said plurality of exterior walls are connected in such a manner as to form an interior cavity, wherein a portion of at least one exterior wall of said plurality of exterior walls comprises one or more tone zones each of which comprises a tonal face disposed on the inner surface of said exterior wall and a corresponding strike face disposed on the outer surface of said exterior wall, wherein each of said one or more tone zones corresponds to a drum sound selected from a group of drum sounds comprising snare drum sounds, bass drum sounds, and tom-tom drum sounds;

an internal tonal structure situated inside said interior cavity, comprising one or more arms, each of said one or more arms comprising one or more of a support arm and a tone generating arm, wherein each of said support arms is configured to provide support to one or more exterior walls of said plurality of exterior walls, and at least one of said tone generating arms abut the inner surface of said exterior wall to define a perimeter and area for the tonal face and corresponding strike face of at least one tone zone on said exterior wall such that said perimeter and area regulate which of said drum sounds is produced by said tone zone, wherein said multi-tonal box drum further comprises an adjustable snare component configured to produce snare drum sounds, wherein said adjustable snare component is capable of being regulated by a snare adjustment component that is adapted to move said adjustable snare component between at least a first tone zone and a second tone zone to alter said snare drum sounds.

12. The multi-tonal box drum of claim 11, wherein said multi-tonal box drum is substantially rectangular in shape.

13. The multi-tonal box drum of claim 11, wherein said multi-tonal box drum further includes a shaker component comprised of a plurality of shaker chambers configured to allow said shaker component to be struck from any direction.

14. The multi-tonal box drum of claim 13, wherein said shaker component engages with one or more exterior walls of said plurality of exterior walls.

15. The multi-tonal box drum of claim 11, wherein said multi-tonal box drum further includes a kick pedal attachment.

16. The multi-tonal box drum of claim 15, wherein said kick pedal attachment is comprised of a kick drum pedal.

17. The multi-tonal box drum of claim 15, wherein said kick pedal attachment is comprised of a beater component.

18. The multi-tonal box drum of claim 17, wherein said beater component is comprised of an attachment rod, an interior dowel rod, a middle cushion component, and an exterior tapping component.

* * * * *